US007286333B2

(12) United States Patent
Kubinski et al.

(10) Patent No.: US 7,286,333 B2
(45) Date of Patent: Oct. 23, 2007

(54) SWITCH CARD APPARATUS AND METHODS

(75) Inventors: Ronald A. Kubinski, Mission Viejo, CA (US); Tuan T. Phan, Arcadia, CA (US); Gregory H. Smith, Placentia, CA (US); Huan N. Nguyen, Garden Grove, CA (US)

(73) Assignee: The Boeing Company, Chicago, IL (US)

( * ) Notice: Subject to any disclaimer, the term of this patent is extended or adjusted under 35 U.S.C. 154(b) by 345 days.

(21) Appl. No.: 10/975,858

(22) Filed: Oct. 28, 2004

(65) Prior Publication Data

US 2006/0098381 A1 May 11, 2006

(51) Int. Cl.
*G01V 1/06* (2006.01)

(52) U.S. Cl. ..... 361/247

(58) Field of Classification Search ..... 361/247
See application file for complete search history.

(56) References Cited

U.S. PATENT DOCUMENTS

| | | | | |
|---|---|---|---|---|
| 3,964,395 | A | 6/1976 | Kaiser et al. | |
| 4,378,738 | A | 4/1983 | Proctor et al. | |
| 4,651,646 | A | 3/1987 | Foresman et al. | |
| 4,726,291 | A | 2/1988 | Lefranc | |
| 4,769,734 | A | 9/1988 | Heinemeyer et al. | |
| 4,848,232 | A | 7/1989 | Kurokawa et al. | |
| 5,363,765 | A | 11/1994 | Aikou et al. | |
| 5,476,044 | A | 12/1995 | Boucher | |
| 5,498,912 | A * | 3/1996 | Templeman et al. | 307/115 |
| 5,753,927 | A * | 5/1998 | Schneider | 250/551 |
| 5,796,274 | A * | 8/1998 | Willis et al. | 327/63 |
| 6,196,130 | B1 | 3/2001 | Crist et al. | |
| 6,267,326 | B1 | 7/2001 | Smith et al. | |
| 6,295,932 | B1 * | 10/2001 | Kane, III | 102/221 |
| 6,584,907 | B2 | 7/2003 | Boucher et al. | |
| 6,600,239 | B2 * | 7/2003 | Winick et al. | 307/85 |
| 6,729,240 | B1 | 5/2004 | Smith et al. | |

* cited by examiner

*Primary Examiner*—Michael Sherry
*Assistant Examiner*—Ann T. Hoang
(74) *Attorney, Agent, or Firm*—Lee & Hayes, PLLC

(57) ABSTRACT

Switch card apparatus are disclosed. In one embodiment, a circuit includes a first portion having a first switch adapted to be coupled to a first voltage, a second portion including a second switch, and a third portion including a third switch. The first portion activates the first switch to couple the first voltage to the second portion. Similarly, the second portion activates the second switch in response to a second input signal and the first voltage to couple a second voltage to the third portion. Finally, the third portion activates the third switch in response to a third input signal and in response to the second voltage from the second portion to couple a control voltage to a load. Embodiments of the invention provide the desired reliability suitable for a variety of electrical systems, including arming and firing applications over a wide voltage and wide current range.

27 Claims, 6 Drawing Sheets

SWITCH CARD APPARATUS AND METHODS

STATEMENT OF GOVERNMENT INTEREST

This invention was made with government support under U.S. Government Contract HQ0006-01-C-0001 awarded by the United States Army. The U.S. Government has certain rights in this invention.

FIELD OF THE INVENTION

The present disclosure relates to switch cards for electrical systems, and more specifically, to switch card apparatus and methods having wide voltage range, high current capability for use with, for example, safe and arm devices for missiles.

BACKGROUND OF THE INVENTION

The handling of live missile boosters presents obvious dangers to personnel. Conventional safe and arm devices are mechanical relays that fully isolate the battery from the squib for purposes of firing train interruption. Applicable specifications (e.g. Mil-STD-1901A) typically require safe and arm devices to include the ability to eliminate a single fault scenario. Particular program requirements may impose more stringent safety specifications.

Although desirable results have been achieved using prior art safe and arm devices, there may be room for improvement. For example, each missile may have a variety of critical signals that must be isolated, each of which may have widely different voltage and current levels. A particular missile's load current variability may be very high with an extremely wide voltage range that requires a specific design solution. Thus, conventional safe and arm devices are typically designed for a particular missile, and lack the capacity to handle the range of voltages and current variabilities presented by multiple missile types.

SUMMARY OF THE INVENTION

The present invention is switch card switch card apparatus and methods for electrical systems. Embodiments of the present invention may provide a safe and reliable solution as an acceptable safe and arm device on multiple missile configurations, meeting or exceeding isolation requirements for safely isolating the battery and squibs and ensures personnel safety during the handling of live missile boosters. Furthermore, embodiments of the present invention may be capable of handling a wide voltage and current range, suitable for use in association with multiple missile and safety applications.

In one embodiment, an arming and firing circuit for applying a control voltage to a load includes a first portion having a first switch adapted to be coupled to a first voltage, a second portion operatively coupled to the first portion and including a second switch, and a third portion operatively coupled to the second portion and adapted to be coupled to the load, the third portion also including a third switch. The first portion is adapted to receive a first input signal and to activate the first switch in response to a first value of the first input signal to couple the first voltage to the second portion. Similarly, the second portion is adapted to receive a second input signal and to activate the second switch in response to a second value of the second input signal and in response to the first voltage from the first portion to couple a second voltage to the third portion. Finally, the third portion is adapted to receive a third input signal and to activate the third switch in response to a third value of the third input signal and in response to the second voltage from the second portion to couple the control voltage to the load.

BRIEF DESCRIPTION OF THE DRAWINGS

Preferred and alternate embodiments of the present invention are described in detail below with reference to the following drawings.

DETAILED DESCRIPTION

The present invention relates to switch card apparatus and methods for electrical systems. Many specific details of certain embodiments of the invention are set forth in the following description and in FIGS. 1-4 to provide a thorough understanding of such embodiments. One skilled in the art, however, will understand that the present invention may have additional embodiments, or that the present invention may be practiced without several of the details described in the following description.

In general, embodiments and apparatus and methods in accordance with the present invention provide a safe and reliable solution as an acceptable safe and arm device on multiple missile configurations, meeting the requirements for safely isolating the battery and the squibs, and ensuring personal safety during the handling of live missile boosters. Because embodiments of the present invention are adapted to handle a wide voltage and current range, multiple missile and safety applications may be safely accommodated.

Figure 1:
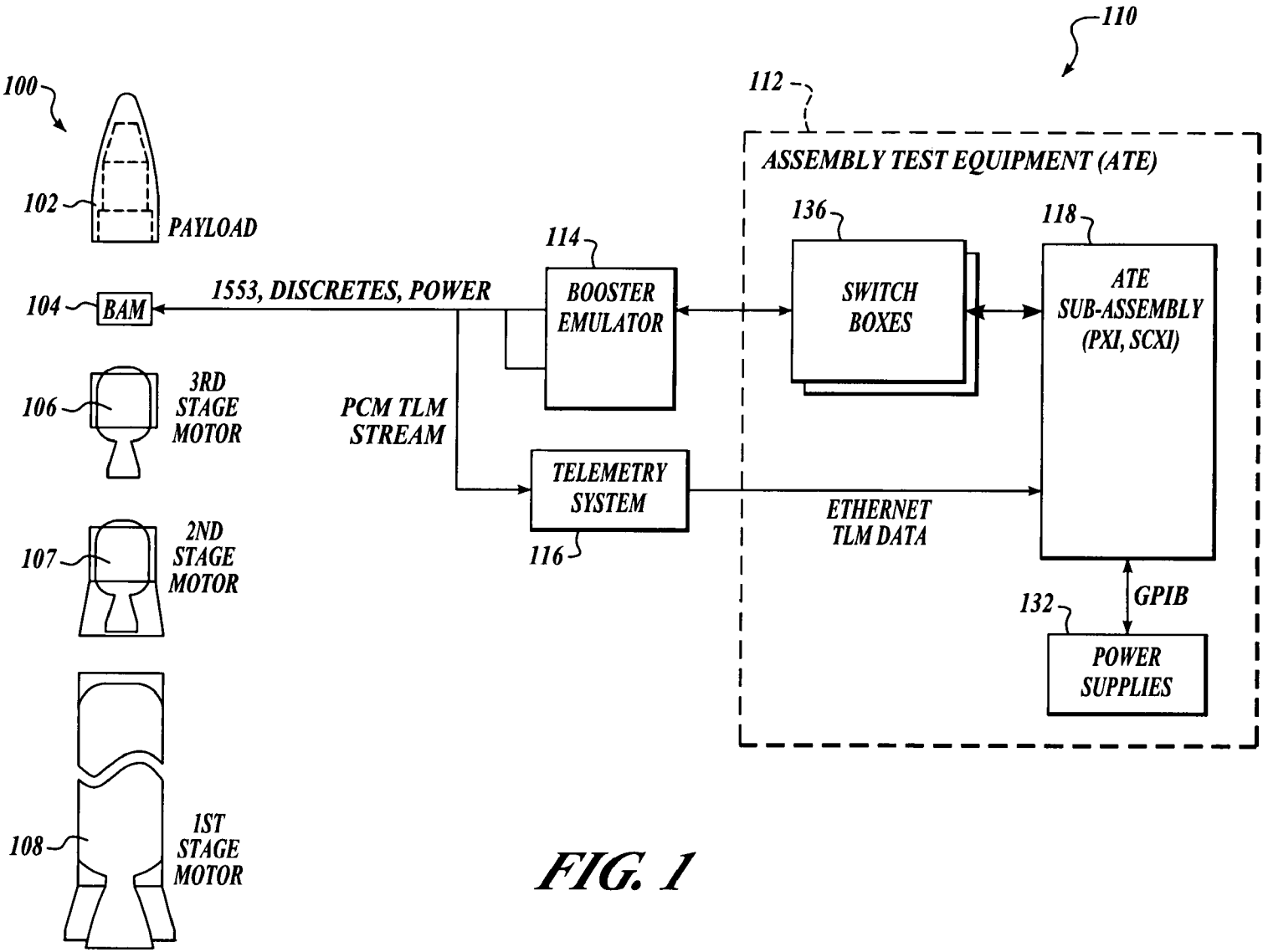
FIG. 1 is a schematic view of a missile assembly coupled to a test system in accordance with an embodiment of the present invention.

FIG. 1 is a schematic view of a missile assembly 100 coupled to a test system 110 in accordance with an embodiment of the present invention. In this embodiment, the missile assembly 100 includes a payload module 102 coupled to a Booster Avionics Module (BAM) 104. The missile assembly 100 further includes a third stage motor 106, a second stage motor 107, and a first stage motor 108. The Booster Avionics Module 104 includes control circuitry coupled to the payload module 102 and to the motors 106, 107, 108, and the BAM 104. The BAM 104 is adapted to receive control signals and to transmit appropriate commands to the various components of the missile assembly 100.

The test system 110 includes an assembly test equipment module 112 coupled to a booster emulator module 114 which is, in turn, coupled to the Booster Avionics Module 104 of the missile assembly 100. The telemetry system 116 receives signals from the control module 104 and transmits the signals to the assembly test equipment module 112.

Figure 2:
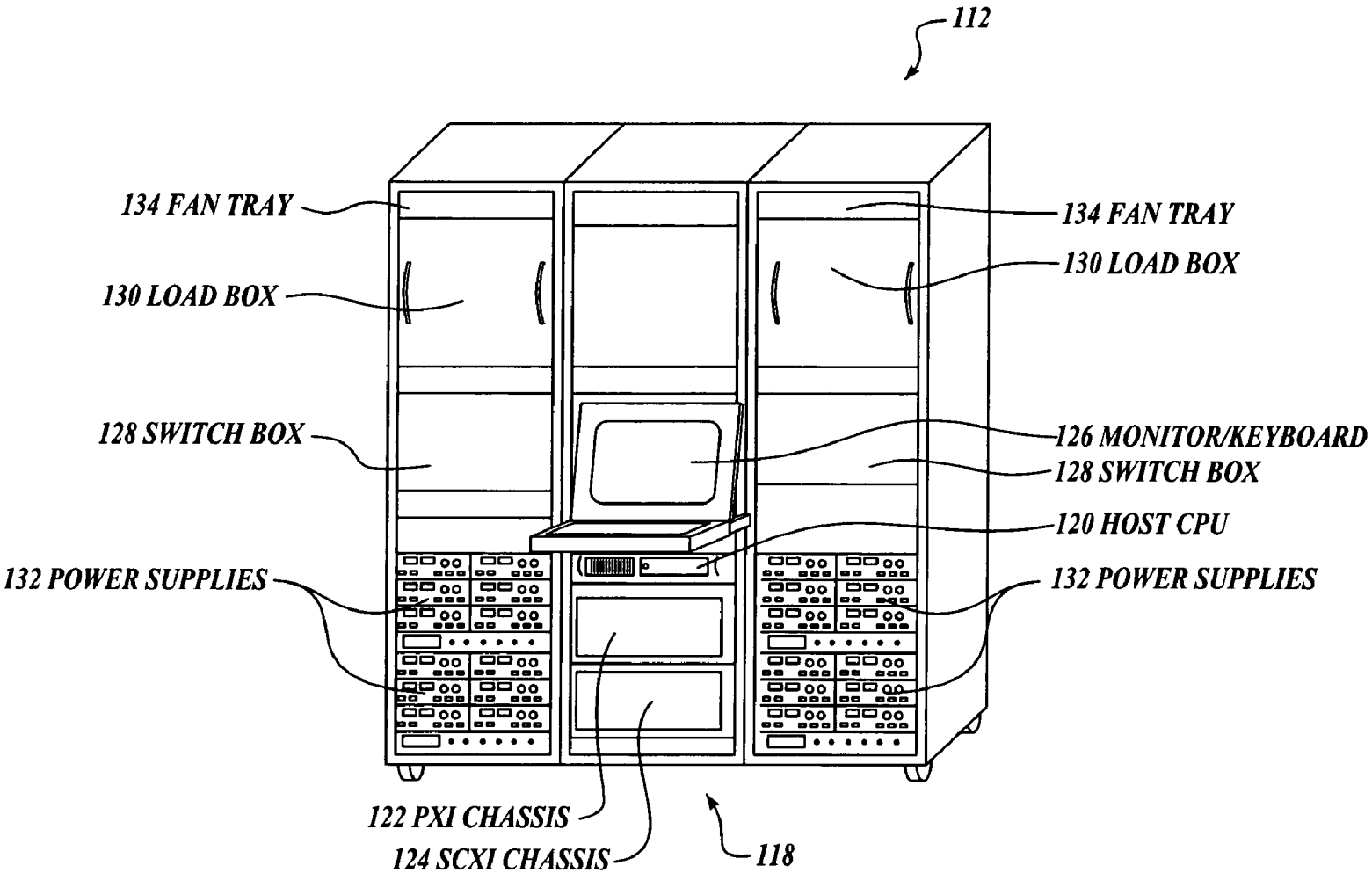
FIG. 2 is an isometric view of the assembly test equipment module of the test system of FIG. 1.

FIG. 2 is an isometric view of the assembly test equipment module 112 of the test system 100 of FIG. 1. As shown and FIGS. 1 and 2, a subassembly 118 of the assembly test equipment module 112 includes a host computer 120 coupled to a first data processing system 122, a second power conditioning system 124, and a monitor and keyboard 126. In one embodiment, the first electronics system 122 may be a PCI eXtensions for Instrumentation (PXI) chassis, and the second electronics chassis 124 may be an SCXI electronics chassis, such as, for example, the models of PXI chassis and SCXI chassis commercially-available from National Instruments Corporation of Austin Texas. In one particular embodiment, the PXI chassis 122 is a single 3U chassis with a PCI back plane. The PXI chassis 122 houses the primary processor and data capture components to support the test/launch functionality in FIG. 1. The embedded processor has state of the art memory and hard drive capability. It may have several high speed Analog to Digital (A to D) cards in the system which provide high speed multiple channels of data capture and sampling, and may also have several programmable events driven opto-isolated digital input/output (DIO) cards and a single TTL DIO card. These cards provide the input stimulus required to drive the input circuits of the Wide Voltage Range Wide Current Range switch cards used primarily to switch ground power to FIG. 100. Each component of the PXI chassis is part of the analog measurement chain required to accurately and safely test/launch the components of FIG. 1.

In one embodiment, the SCXI 124 is a 4U chassis that houses signal conditioning boards which will manipulate the analog voltages into the appropriate ranges required to feed the A to D cards. The SCXI contains a programmable switch matrix card used in conjunction with the analog measurement system to measure assembly test equipment simulated load box parameters. Each component of the PXI chassis is part of the analog measurement chain required to accurately and safely test/launch the components of FIG. 1. The subassembly 118 also includes a pair of switch boxes 128, which contain multiple versions of the invention, and load boxes 130. Power supplies 132 are coupled to the subassembly 118, and fans 134 provide cooling flow to the components of the assembly test equipment module 112, specifically to 128 and 130. Switch card boxes 136 are coupled between the subassembly 118 and the booster emulator module 114.

Figure 3:
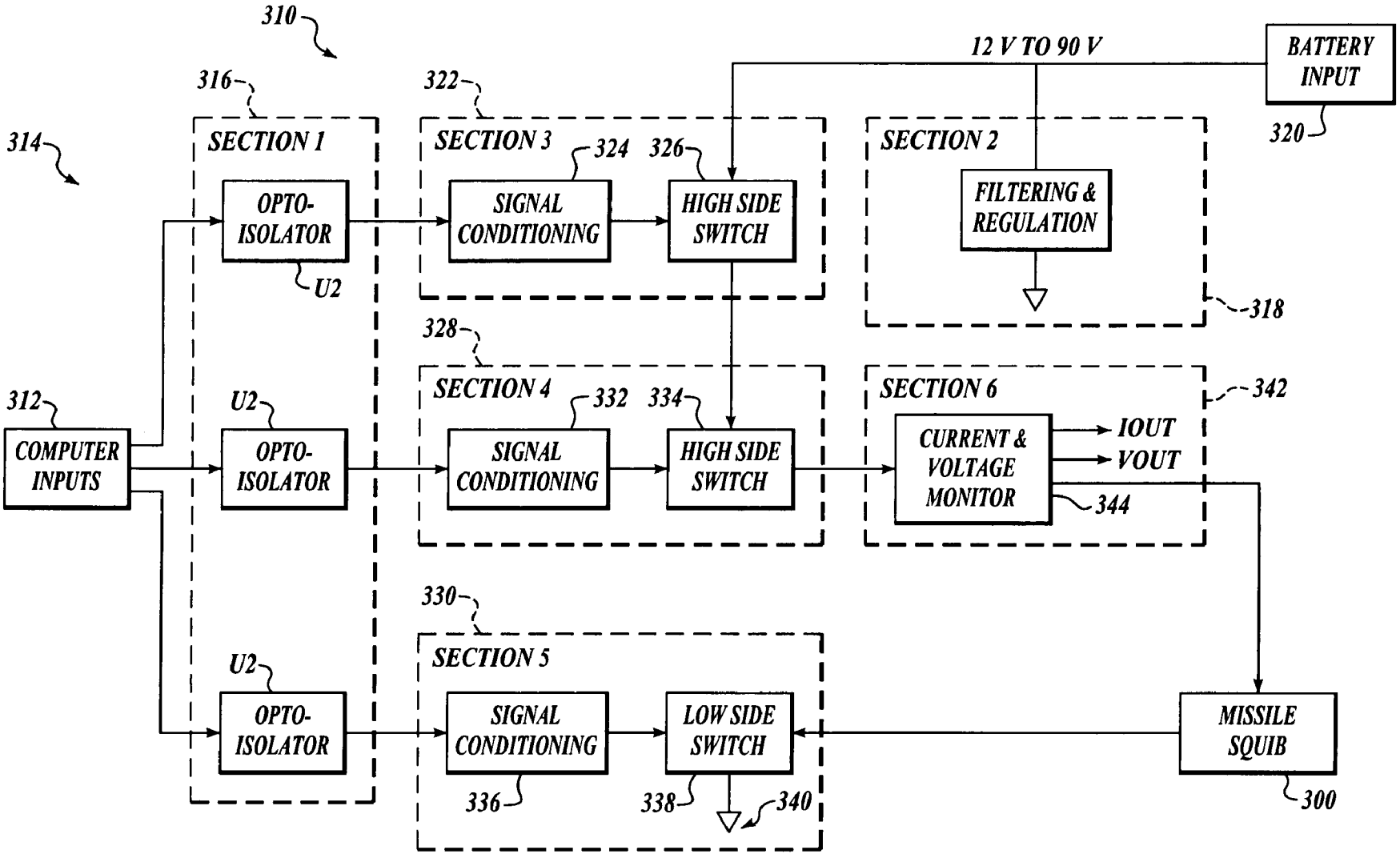
FIG. 3 is a block diagram of a missile assembly coupled to a test system in accordance with an embodiment of the invention.

FIG. 3 is a block diagram of a missile assembly 300 coupled to a test system 310 in accordance with an embodiment of the invention. The missile assembly can include both squibs to activate various systems within the First Stage Motor 108, Second Stage Motor, 107, and Third Stage Motor 106, or sequenced power inputs within the Payload 102, BAM 104, First Stage Motor 108, Second Stage Motor, 107, and Third Stage Motor 106. In this embodiment, the test system 310 includes a computer 312 that provides inputs to a switch card 314. In turn, the outputs of the switch card 314 are coupled to the missile assembly 300. In operation, the switch card 314 advantageously has the capability of driving resistive or inductive-resistive loads over a wide voltage range and wide current range. For example, in one particular embodiment, the switch card 314 has the capability of driving resistive or inductive loads over a voltage range of 12 to 100 V, and a current range of 0 to 12 Amps. Minor adaptations to this circuit can substantially increase both the voltage and current range.

Figure 4:
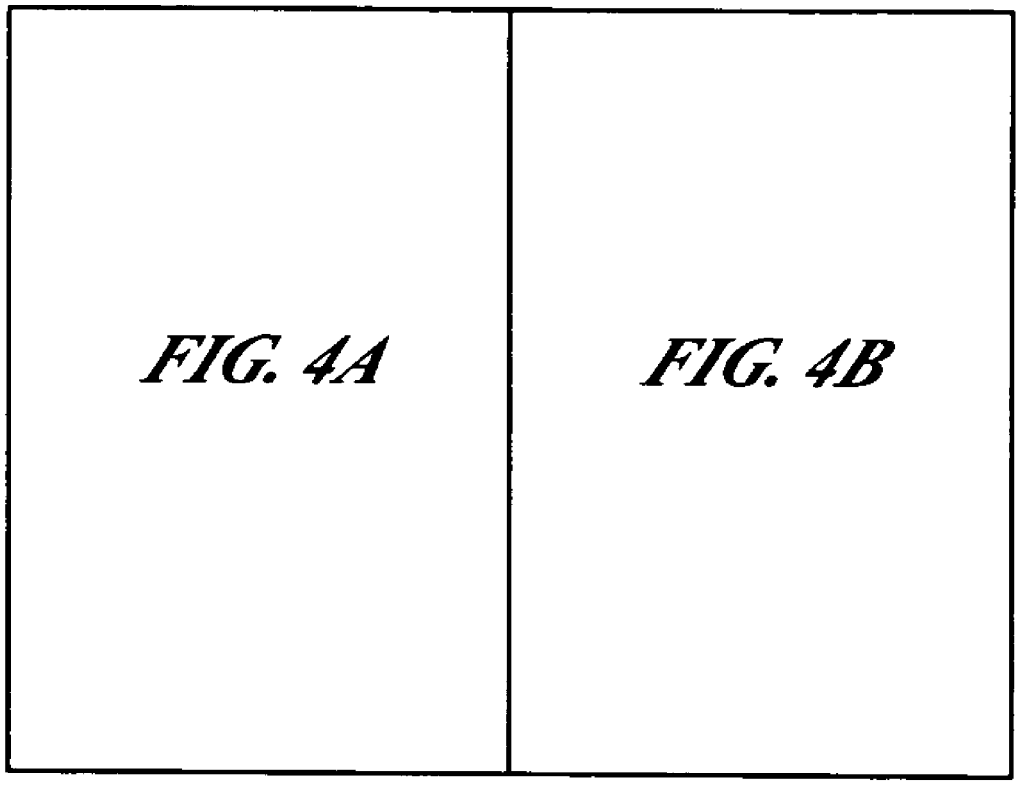
FIG. 4 is a circuit diagram of the switch card of FIG. 3.
Figure 4A:
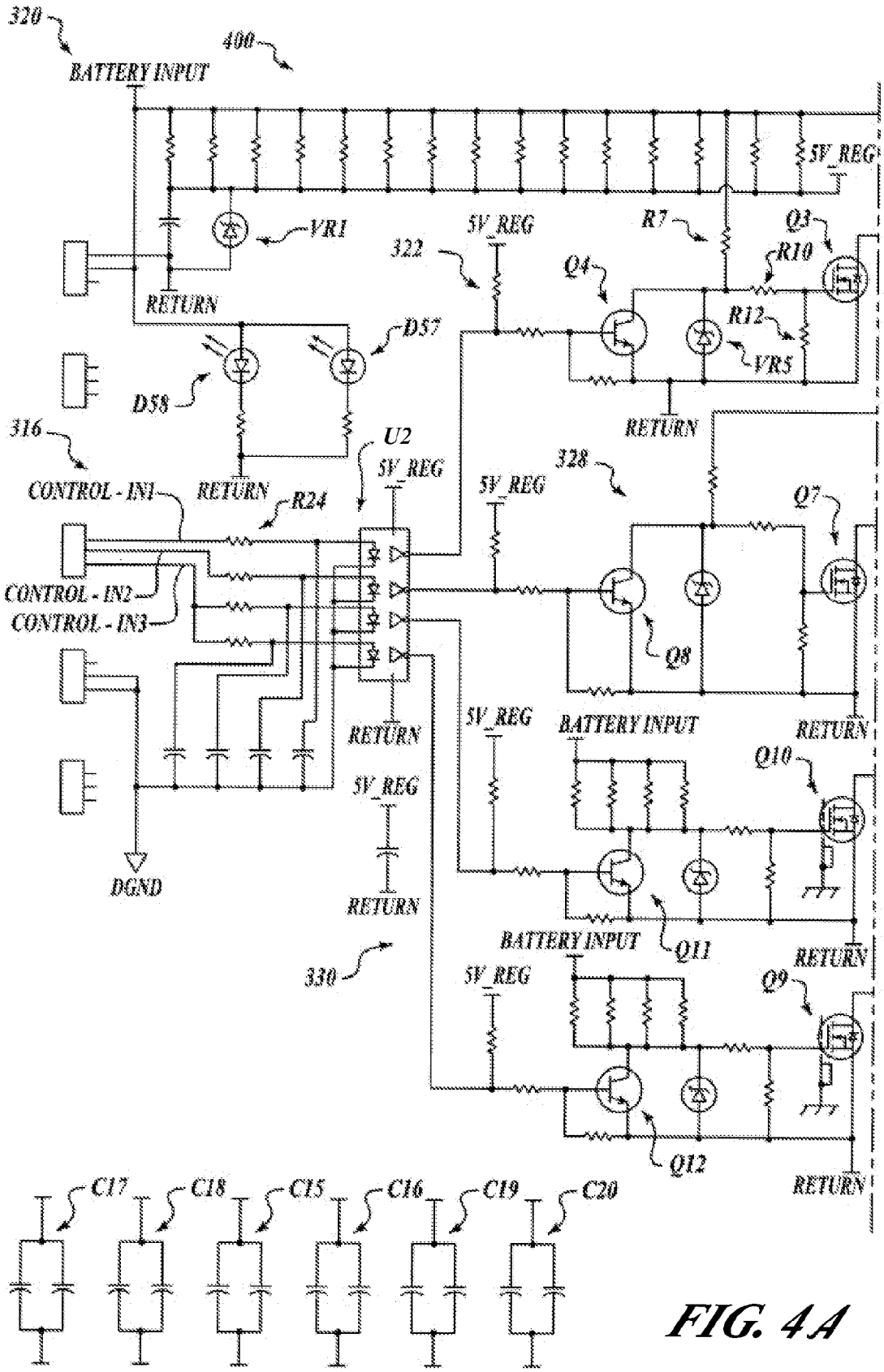
Figure 4B:
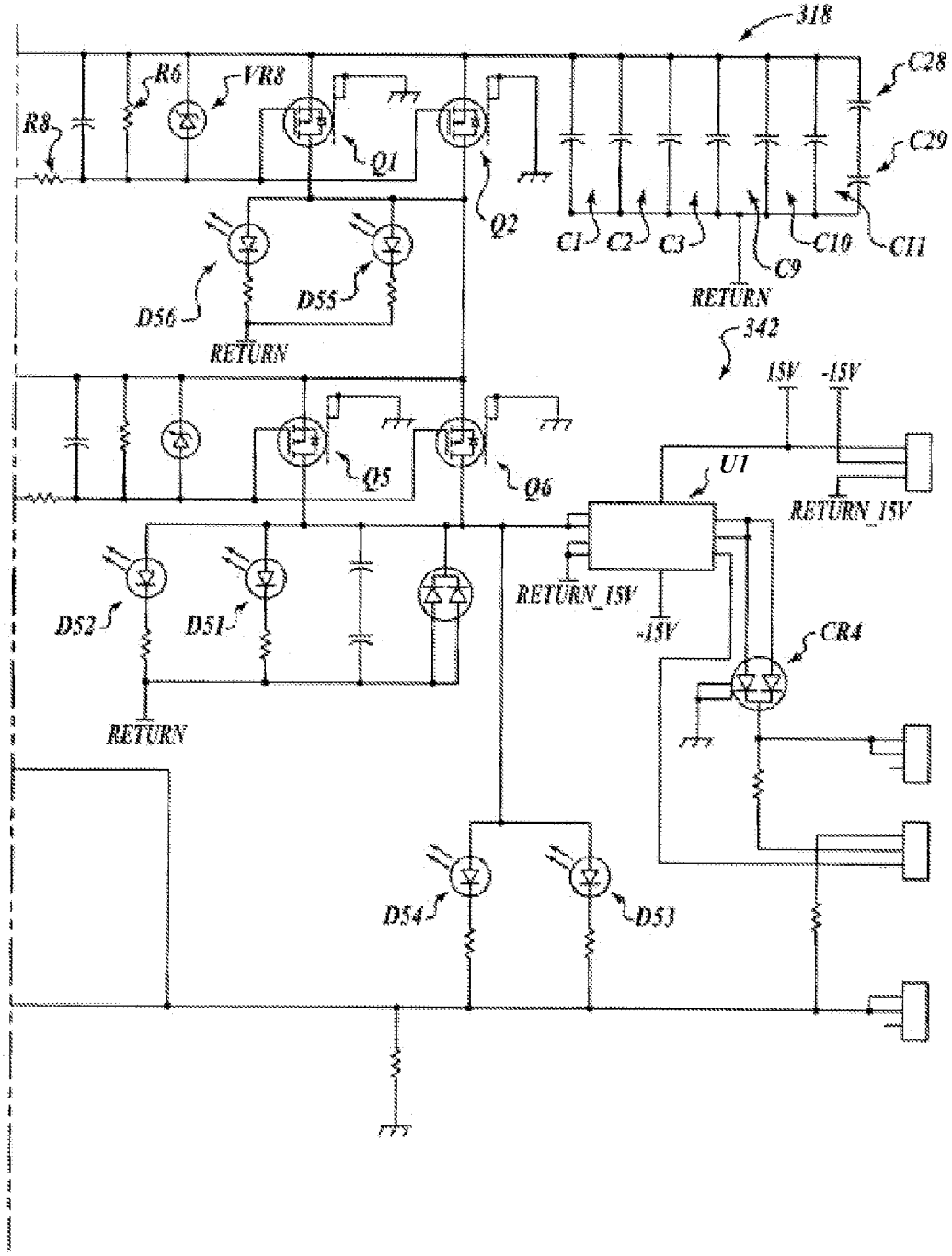

FIG. 4 is a circuit diagram 400 of the switch card 314 of FIG. 3. As shown in FIGS. 3 and 4, the switch card 314 may be divided into six sections for simplicity. A first section 316 (Section 1) performs input signal conversion. Three independent input signals (CONTROL_IN1, CONTROL_IN2, and CONTROL_IN3) must be initiated for circuit activation (two fault tolerant system). Each input signal passes through an optocoupler (or optoisolator) (U2) which provides ground and noise isolation between the computer input signals and the firing circuitry (Sections 2-6) described below. As used in this application, the terms optocoupler and optoisolator are used interchangeably.

A second section 318 (Section 2) provides the filtering for an input battery voltage 320 and dc voltages (Cl-C3, C9-C11, C15-C20, and C28-C29) and a voltage regulation (VR1). A third section 322 (Section 3) includes signal conditioning 324 and high side switch circuitry 326 for the first input signal CONTROL_IN1. The third section 322 works as a safe and arm for the firing circuitry of fourth and fifth sections 328, 330 (Sections 4 and 5). As shown in FIG. 4, when activated, a signal out of the optocoupler U2 enters the third section 322 and deactivates a first transistor Q4, which turns on a second transistor Q3, and then a third transistor Q1, and a fourth transistor Q2. In one embodiment, the second transistor Q3 is an n-channel MOSFET which turns on the p-channel MOSFETs Q1 and Q2. Transistors Q1 and Q2 are connected in parallel to allow increased current capability. Transistors Q1 and Q2 also separate the battery power 320 from next stage circuitry. When the third section 322 (Section 3) is deactivated, the first transistor Q4 turns on, which shuts off transistors Q3, Q1, and Q2.

Specifically, in the embodiment show in FIG. 4, the activation works as follows: the first input signal CONTROL_IN1 (e.g. a +5V signal) comes from the computer inputs 312 into a resistor R24 and the optocoupler U2. The first input signal CONTROL_IN1 turns on a light emitting diode inside of the optocoupler U2 forcing the output of the optocoupler U2 to go low. This shuts off the first transistor Q4, which produces a voltage divider output at resistors R7, R10, and R12 (e.g. of 12 V) at the gate-to-source of transistor Q3. This turns on the second transistor Q3 setting up another voltage divider at resistors R6 and R8 (e.g. of 12 V) from transistors Q1 and Q2 gate to source. Transistors Q1 and Q2 then turn on, thereby closing the switch 326 (FIG. 3) and allowing the battery voltage 320 to go to the fourth section 328 (Section 4). This activation pattern is similar in the fourth and fifth sections 328, 330 (Sections 4 and 5). A pair of diodes VR5 and VR8 (e.g. Zener diodes) limit the maximum divider voltage across the gate to source of the transistors Q3, Q1, and Q2 (e.g. to 15 V) over a relatively wide voltage range input (e.g. 12 to 100 Vdc).

The deactivation works as follows: a deactivation signal (e.g. 0V) comes from the computer 312 into the resistor R24 and the optocoupler U2. The deactivation signal turns off the light emitting diode inside of the optocoupler U2 forcing the output of the optocoupler U2 to go high. This turns on transistor Q4, grounding off transistor Q3. With transistor Q3 off, the gate to source voltage across transistors Q1 and Q2 is zero, keeping both transistors Q1 and Q2 off, and opening the switch 326. This deactivation pattern is also similar in the fourth and fifth sections 328, 330 (Sections 4 and 5).

As mentioned above, the fourth section 328 (Section 4) works in a similar manner to the third section 322 (Section 3) and includes a signal conditioning 332 and a high side switch circuitry 334 for a second input signal CONTROL_IN2. When activated, the signal out of the Optocoupler U2 deactivates Q8, which turns on transistor Q7, and then transistors Q5, and Q6. In a presently preferred embodiment, transistor Q7 is an n-channel MOSFET which turns on the p-channel MOSFETs Q5 and Q6. Transistors Q5 and Q6 are connected in parallel to allow increased current capability. Transistors Q5 and Q6 also separate the third section power from the load (missile squib) 300. When the fourth section 328 (Section 4) is deactivated, transistor Q8 turns on, which shuts off transistors Q7, Q5, and Q6. The fourth section 328 also contains diodes (CR4) for reverse voltage protection and for the option of additional current summing of modules.

With continued reference to FIGS. 3 and 4, the fifth section 330 (Section 5) includes signal conditioning 336 and low side switch circuitry 338 for the third input signal CONTROL_IN3. When activated, the signal out of the optocoupler U2 deactivates transistors Q11 and Q12, which turns on transistors Q10 and Q9. Again, in one embodiment, transistors Q10 and Q9 are n-channel MOSFETs and are connected in parallel to allow increased current capability. Transistors Q10 and Q9 separate the load from ground 340. When the fifth section 330 (Section 5) is deactivated, transistors Q11 and Q12 turn on, which shuts off transistors Q10 and Q9.

A sixth section 342 (Section 6) includes load current and load voltage telemetry monitoring circuitry 344. The telemetry current out of a current sensor Ul, in one embodiment equal to a load current divided by 10, is sent as a voltage to telemetry. The resulting telemetry load voltage is a buffered output of the load voltage. Light emitting diodes (LEDs) D51-D58 are also utilized to indicate when the battery input and Sections 3, 4, and 5 are activated.

Embodiments of the present invention may provide significant advantages over prior art safe and arm devices. For example, embodiments of the present invention provide a safe and reliable solution as an acceptable safe and arm device on multiple missile configurations, meeting or exceeding isolation requirements for safely isolating the battery and squibs and ensures personnel safety during the handling of live missile boosters. Embodiments of the present invention also provide multiple fault tolerances. Furthermore, because embodiments of the present invention are capable of handling a wide voltage and current range, such embodiments are suitable for use in association with multiple missile and safety applications.

While preferred and alternate embodiments of the invention have been illustrated and described, as noted above, many changes such as adding equivalent blocks (FIG. 3, sections 3, 4, or 5), can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An apparatus comprising:

an arming and firing circuit for applying a control voltage to a load, the arming and firing circuit comprising:

a first portion including a first switch configured to be coupled to a first voltage;

a second portion operatively coupled to the first portion and including a second switch; and a third portion operatively coupled to the second portion and configured to be coupled to the load, the third portion including a third switch;

wherein the first portion is configured to receive a first input signal and to activate the first switch in response to a first value of the first input signal to couple the first voltage to the second portion;

wherein the second portion is configured to receive a second input signal and to activate the second switch in response to a second value of the second input signal and in response to the first voltage from the first portion to couple a second voltage to the third portion;

wherein the third portion is configured to receive a third input signal and to activate the third switch in response to a third value of the third input signal and in response to the second voltage from the second portion to couple the control voltage to the load; and wherein the first portion includes:

an optocoupler coupled to receive the first input signal and configured to output a low signal in response to the first value of the first input signal;

a first transistor coupled to the optocoupler and configured to shut off in response to the low signal from the optocoupler;

a second transistor coupled to the first transistor and configured to turn on in response to the shut off of the first transistor; and third and fourth transistors coupled in parallel and coupled to the second transistor, the third and fourth transistors being further coupled between the first voltage and the second portion and being configured to turn on in response to the second transistor turning on, thereby coupling the first voltage to the second portion.

2. The arming and firing circuit of claim 1, wherein at least one of the first switch and the second switch comprises a high side switch.

3. The arming and firing circuit of claim 1, wherein the third switch comprises a low side switch.

4. The aiming and firing circuit of claim 1, wherein the first switch comprises a first high side switch, the second switch comprises a second high side switch, and the third switch comprises a low side switch.

5. The arming and firing circuit of claim 1, wherein at least one of the first, second, and third portions includes a signal conditioning portion.

6. The arming and firing circuit of claim 1, wherein the first portion is further adapted to deactivate the first switch in response to a fourth value of the first input signal to decouple the first voltage from the second portion.

7. The arming and firing circuit of claim 6, wherein the second portion is further adapted to deactivate the second switch in response to a fifth value of the second input signal to decouple the second voltage from the third portion.

8. The aiming and firing circuit of claim 7, wherein the third portion is further adapted to deactivate the third switch in response to a sixth value of the third input signal to decouple the control voltage from the load.

9. The arming and firing circuit of claim 1, wherein the first portion further includes at least one diode operatively coupled across the second transistor and adapted to limit a maximum voltage applied thereto.

10. A switch card for an arming and firing apparatus, comprising:

a non-conducting substrate; and a circuit disposed on the substrate and configured to apply a control voltage to a load of the arming and firing apparatus, the circuit comprising:

a first portion including a first switch configured to be coupled to a first voltage;

a second portion operatively coupled to the first portion and including a second switch;

a third portion operatively coupled to the second portion and configured to be coupled to the load, the third portion including a third switch;

wherein the first portion is adapted to receive a first input signal and to activate the first switch in response to a first value of the first input signal to couple the first voltage to the second portion;

wherein the second portion is configured to receive a second input signal and to activate the second switch in response to a second value of the second input signal and in response to the first voltage from the first portion to couple a second voltage to the third portion;

wherein the third portion is configured to receive a third input signal and to activate the third switch in response to a third value of the third input signal and in response to the second voltage from the second portion to couple the control voltage to the load; and wherein the first portion includes:

an optocoupler coupled to receive the first input signal and configured to output a low signal in response to the first value of the first input signal;

a first transistor coupled to the optocoupler and configured to shut off in response to the low signal from the optocoupler;

a second transistor coupled to the first transistor and configured to turn on in response to the shut off of the first transistor; and third and fourth transistors coupled in parallel and coupled to the second transistor, the third and fourth transistors being further coupled between the first voltage and the second portion and being configured to turn on in response to the second transistor turning on, thereby coupling the first voltage to the second portion.

11. The switch card of claim 10, wherein the first switch comprises a first high side switch, the second switch comprises a second high side switch, and the third switch comprises a low side switch.

12. The switch card of claim 10, wherein at least one of the first, second, and third portions includes a signal conditioning portion.

13. The switch card of claim 10, wherein the first portion is further adapted to deactivate the first switch in response to a fourth value of the first input signal to decouple the first voltage from the second portion.

14. The switch card of claim 11, wherein the second portion is further adapted to deactivate the second switch in response to a fifth value of the second input signal to decouple the second voltage from the third portion.

15. The switch card of claim 14, wherein the third portion is further adapted to deactivate the third switch in response to a sixth value of the third input signal to decouple the control voltage from the load.

16. An arming and firing apparatus for applying a control voltage to a load, comprising:

a control system of the arming and firing apparatus including a signal source;

a switch card operatively coupled to the signal source, the switch card including: a non-conducting substrate; and a circuit disposed on the substrate and configured to apply a control voltage to a load, the circuit comprising:

a first portion including a first switch configured to be coupled to a first voltage; a second portion operatively coupled to the first portion and including a second switch;

a third portion operatively coupled to the second portion and configured to be coupled to the load, the third portion including a third switch;

wherein the first portion is configured to receive a first input signal and to activate the first switch in response to a first value of the first input signal to couple the first voltage to the second portion;

wherein the second portion is configured to receive a second input signal and to activate the second switch in response to a second value of the second input signal and in response to the first voltage from the first portion to couple a second voltage to the third portion;

wherein the third portion is configured to receive a third input signal and to activate the third switch in response to a third value of the third input signal and in response to the second voltage from the second portion to couple the control voltage to the load; and wherein the first portion includes:

an optocoupler coupled to receive the first input signal and configured to output a low signal in response to the first value of the first input signal;

a first transistor coupled to the optocoupler and configured to shut off in response to the low signal from the optocoupler;

a second transistor coupled to the first transistor and configured to turn on in response to the shut off of the first transistor; and third and fourth transistors coupled in parallel and coupled to the second transistor, the third and fourth transistors being further coupled between the first voltage and the second portion and being configured to turn on in response to the second transistor turning on, thereby coupling the first voltage to the second portion.

17. The apparatus of claim 16, wherein the first switch comprises a first high side switch, the second switch comprises a second high side switch, and the third switch comprises a low side switch.

18. The apparatus of claim 16, wherein at least one of the first, second, and third portions includes a signal conditioning portion.

19. The apparatus of claim 16, wherein the first portion is further adapted to deactivate the first switch in response to a fourth value of the first input signal to decouple the first voltage from the second portion.

20. The apparatus of claim 19, wherein the second portion is further adapted to deactivate the second switch in response to a fifth value of the second input signal to decouple the second voltage from the third portion.

21. The apparatus of claim 20, wherein the third portion is further adapted to deactivate the third switch in response to a sixth value of the third input signal to decouple the control voltage from the load.

22. A method of applying a control voltage to a load, comprising:

providing an arming and firing circuit having a first portion including a first switch configured to be coupled to a first voltage, a second portion operatively coupled to the first portion and including a second switch, and a third portion operatively coupled to the second portion and configured to be coupled to the load, the third portion including a third switch;

receiving a first input signal into the first portion and activating the first switch in response to a first value of the first input signal to couple the first voltage to the second portion;

receiving a second input signal into the second portion and activating the second switch in response to a second value of the second input signal and in response to the first voltage from the first portion to couple a second voltage to the third portion;

receiving a third input signal into the third portion and activating the third switch in response to a third value of the third input signal and in response to the second voltage from the second portion to couple the control voltage to the load; and wherein activating the first switch in response to a first value of the first input signal comprises:

outputting a low signal from an optocoupler in response to the first value of the first input signal;

shutting off a first transistor coupled to the optocoupler in response to the low signal from the optocoupler;

turning on a second transistor coupled to the first transistor in response to the shutting off of the first transistor; and turning on third and fourth transistors coupled in parallel and coupled to the second transistor, in response to the second transistor turning on, thereby coupling the first voltage to the second portion.

23. The method of claim 22, wherein providing a circuit comprises providing a circuit wherein the first switch comprises a first high side switch, the second switch comprises a second high side switch, and the third switch comprises a low side switch.

24. The method of claim 22, wherein providing a circuit comprises providing a circuit wherein at least one of the first, second, and third portions includes a signal conditioning portion.

25. The method of claim 22, further comprising deactivating the first switch in response to a fourth value of the first input signal to decouple the first voltage from the second portion.

26. The method of claim 25, further comprising deactivating the second switch in response to a fifth value of the second input signal to decouple the second voltage from the third portion.

27. The method of claim 22, further comprising deactivating the third switch in response to a sixth value of the third input signal to decouple the control voltage from the load.

* * * * *